United States Patent [19]

Goldfarb et al.

[11] Patent Number: 4,492,058

[45] **Date of Patent: * Jan. 8, 1985**

[54] ULTRACOMPACT MINIATURE TOY VEHICLE WITH FOUR-WHEEL DRIVE AND UNUSUAL CLIMBING CAPABILITY

[75] Inventors: Adolph E. Goldfarb, 1432 SE. Wind Cir., Westlake Village, Calif. 91361; Delmar K. Everitt, Woodland Hills, Calif.

[73] Assignee: Adolph E. Goldfarb, Westlake Village, Calif.

[ * ] Notice: The portion of the term of this patent subsequent to Dec. 22, 1998 has been disclaimed.

[21] Appl. No.: 417,554

[22] Filed: Sep. 13, 1982

Related U.S. Application Data

[63] Continuation of Ser. No. 233,495, Feb. 11, 1981, abandoned, which is a continuation-in-part of Ser. No. 121,645, Feb. 14, 1980, Pat. No. 4,306,375.

[51] Int. Cl.[3] ..... A63H 17/00

[52] U.S. Cl. ..... 446/462

[58] Field of Search ..... 46/251, 252, 253, 254, 46/256, 261, 262

[56] References Cited

U.S. PATENT DOCUMENTS

| | | | |
|---|---|---|---|
| 3,080,827 | 3/1963 | Zion | 46/251 X |
| 3,501,863 | 3/1970 | Matsushiro | 46/251 |
| 3,810,515 | 5/1974 | Ingro | 46/251 |
| 3,849,931 | 11/1974 | Gulley, Jr. | 46/251 |
| 3,977,758 | 8/1976 | Mabuchi | 46/251 X |
| 4,306,375 | 12/1981 | Goldfarb et al. | 46/251 |

*Primary Examiner*—Mickey Yu

*Attorney, Agent, or Firm*—Romney Golant Martin & Ashen

[57] ABSTRACT

A toy vehicle only slightly longer than a "penlight" battery, and with chassis less than twice the width of such a battery, is able (traction permitting) to climb any grade on which it will not tip over backward—grades up to about 40°—and to negotiate a vertical step taller than its tire radius. The AA-battery-powered four-wheel-drive vehicle has a small electric motor with a double-ended shaft, and a symmetrical gearing system consisting of, at each end of the motor, a pinion fixed on the shaft, a spur gear driven by the pinion and driving a worm, and a worm gear keyed to a corresponding axle. The motor, pinions, spur gears and worms, and the upper portions of the worm gears, are aligned along one side wall inside the vehicle chassis, with the battery alongside them occupying the rest of the chassis. Traction and climbing characteristics are enhanced by twice-overscale tires, preferably of open foam, with highly pronounced treads. A light distributor in the vehicle simulates two headlights, using light from a single light bulb.

5 Claims, 8 Drawing Figures

FIG. 5
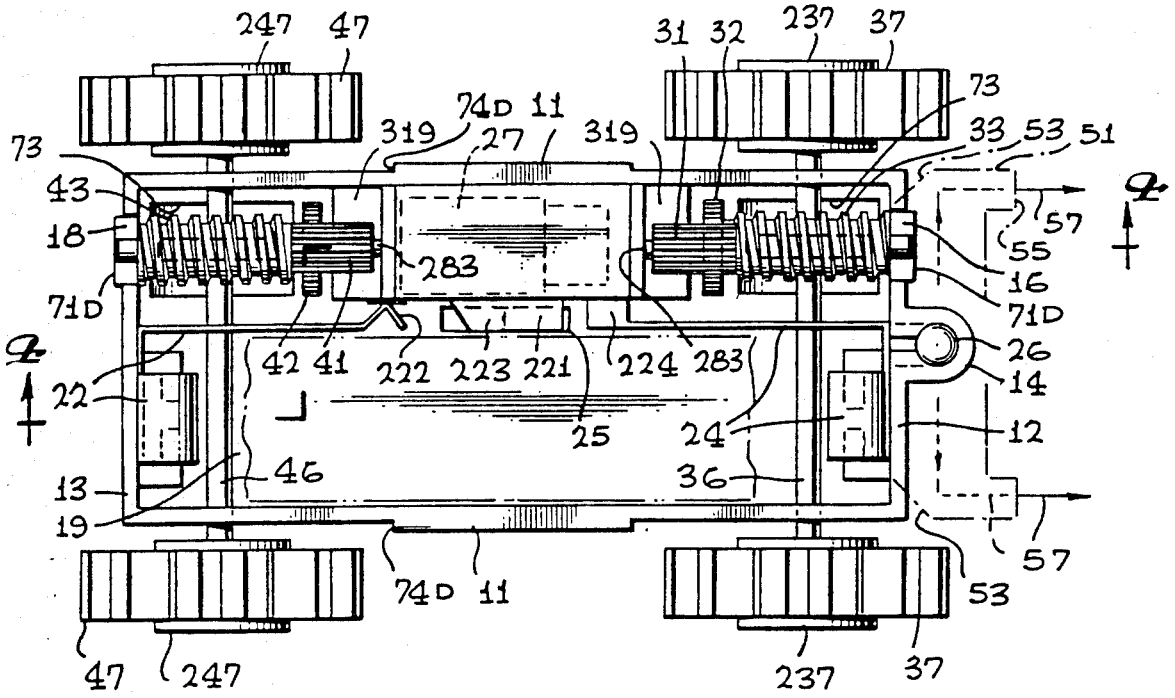
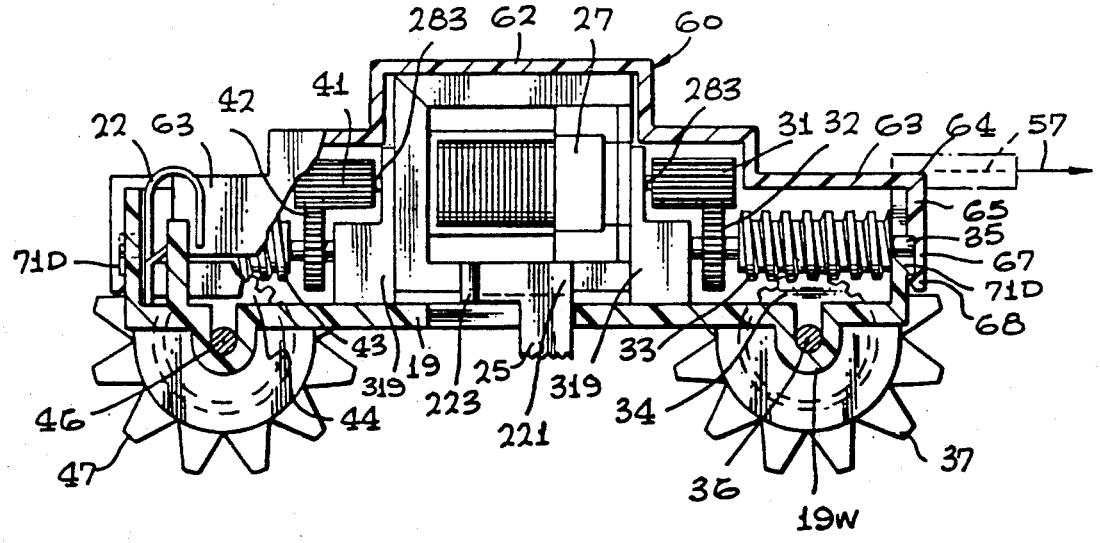
FIG. 6

ULTRACOMPACT MINIATURE TOY VEHICLE WITH FOUR-WHEEL DRIVE AND UNUSUAL CLIMBING CAPABILITY

RELATED APPLICATIONS

This application is a continuation of pending U.S. patent application Ser. No. 233,495 filed Feb. 11, 1981, and now abandoned, which was in turn a continuation-in-part of U.S. patent application Ser. No. 121,645 filed Feb. 14, 1980, now issued U.S. Pat. No. 4,306,375 issued Dec. 22, 1981.

BACKGROUND OF THE INVENTION

1. Field

This invention is in the field of toy vehicles, and particularly relates to self-powered miniature toy vehicles capable of negotiating steep and irregular surfaces.

2. Prior Art

Previous toys of the type described above, whether powered by wind-up springs, electric motors or otherwise, have been relatively large—to accommodate conventional gear trains, as well as power sources and electrical or spring motors.

Some four-wheel-drive toy vehicles have made use of chain or belt drive to convey power between the axles; such drive tended to impede "ground" clearance between the axles as well as detracting from ruggedness and reliability of the toy. In addition, miniaturization of prior four-wheel-drive toy vehicles has been hindered by the space required for multistage gear trains preceding the belt or chain drive.

To overcome inadequate traction, many prior climbing toys have had cogged wheels—i.e., have used gears for wheels—and have been adapted primarily for climbing cogged tracks.

An object of our present invention is to provide an unusually small four-wheel-drive toy vehicle able to climb extremely steep and irregular surfaces without belt or chain drive or cogged track.

SUMMARY OF THE DISCLOSURE

The above-described objects have been achieved by using a small motor with a dual driveshaft—that is to say, a driveshaft accessible at both ends of the motor housing—and by driving the two axles through a dual, symmetrical gear train of only one or two stages at each end of the vehicle. In particular, most or all of the needed gear reduction is obtained with a separate worm-and-worm-gear combination for each end of the vehicle, the worm being driven from one of the motor driveshaft ends and the worm gear being keyed to or otherwise secured for rotation with the corresponding axle. In a preferred embodiment, a small factor in the necessary mechanical advantage is achieved with a pinion-and-spur-gear combination between each motor driveshaft end and the corresponding worm, for reasons to be detailed below.

This novel form of drive train is uniquely and ideally adapted to be miniaturized, and to be made to occupy only a narrow space along one side of a miniature vehicle chassis, the remaining space being thus made available for a standard size-AA "penlight" battery. The chassis and its contents are covered, and mostly concealed, by a miniature toy vehicle body—which snaps on and off to permit changing the battery. For each toy such a body could be made available from a variety of styles respectively resembling actual full-size vehicles, or style composites thereof.

Taking the interaxle spacing to establish the scale for a standard-looking miniature toy vehicle body, climbing characteristics are enhanced by using tires which are overscale by as much as a factor of two. Traction is improved by making the tires of a soft, pliable material—preferably plastic foam whose cell structure is open to the ambient, particularly the periphery of the tire where it grips the operating surface. Traction is further improved by defining extremely exaggerated treads in the tires.

Appeal and usability of the miniature toy vehicle are further promoted by providing headlights for the vehicle which are illuminated by a single small light bulb, the light being distributed to the two headlight positions by a novel light-distributor structure which wraps around the bulb and features two internal corner reflectors which intercept some of the light from the bulb and redirect it forward through "headlight" orifices in the vehicle body. Appeal and usability are also promoted by supplying a suitable surface on which to operate the vehicle, though users will find that operating it on whatever irregular surfaces may be available is also interesting and amusing.

The foregoing principles and features of our invention may be more readily understood and visualized from the detailed description which follows, together with reference to the accompanying figures, of which:

BRIEF DESCRIPTION OF THE DRAWINGS

FIGS. 4 and 5 are respectively elevation and plan views of the FIG. 1 preferred embodiment, FIG. 4 being partly in section and taken along the dogleg line 4—4 in FIG. 5.

DETAILED DESCRIPTION OF THE PREFERRED EMBODIMENTS

Figure 1:
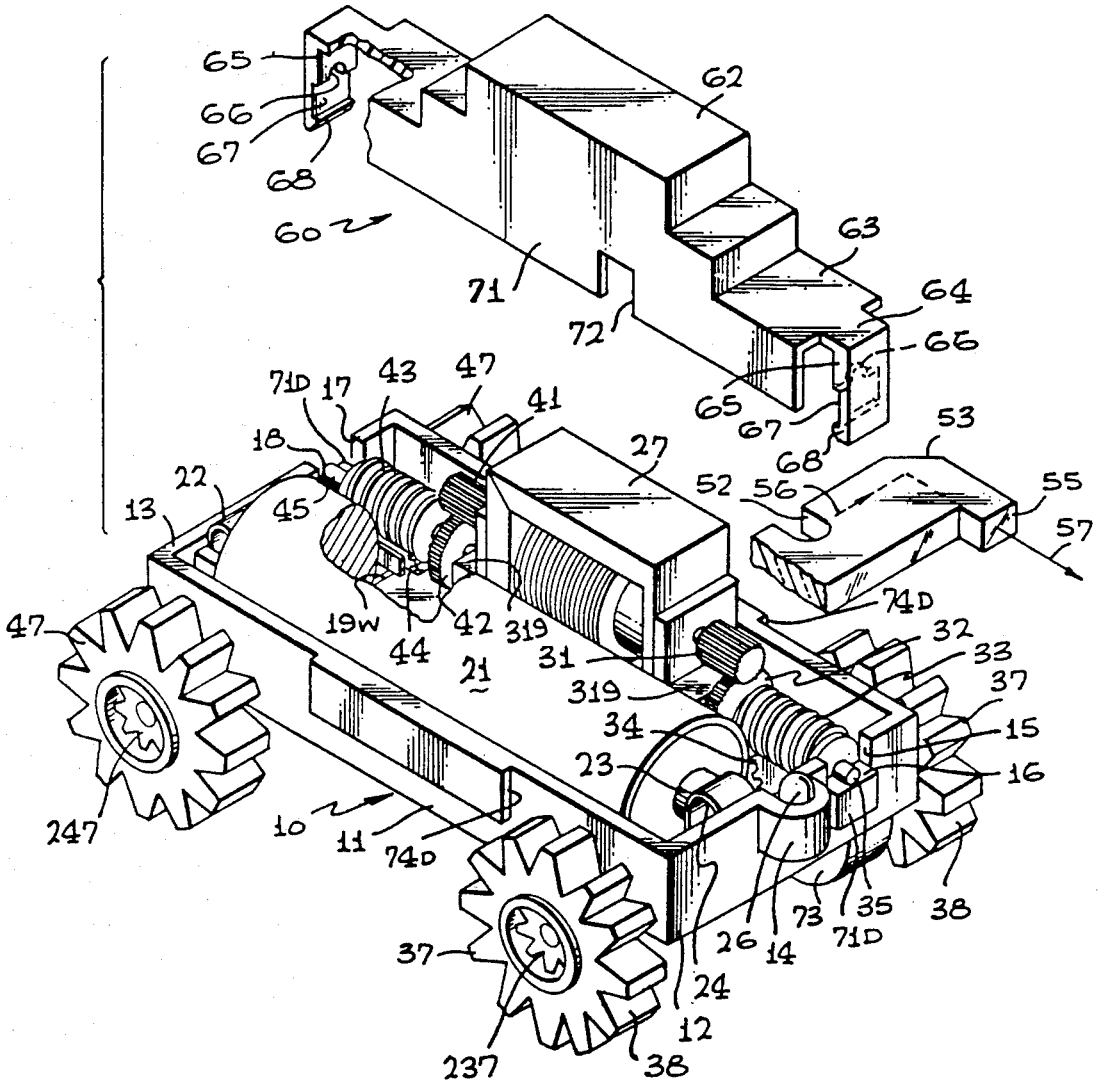
FIG. 1 is a perspective view of a toy vehicle which is a preferred embodiment of our invention, shown without a scale-model vehicle body in place.
Figure 8:
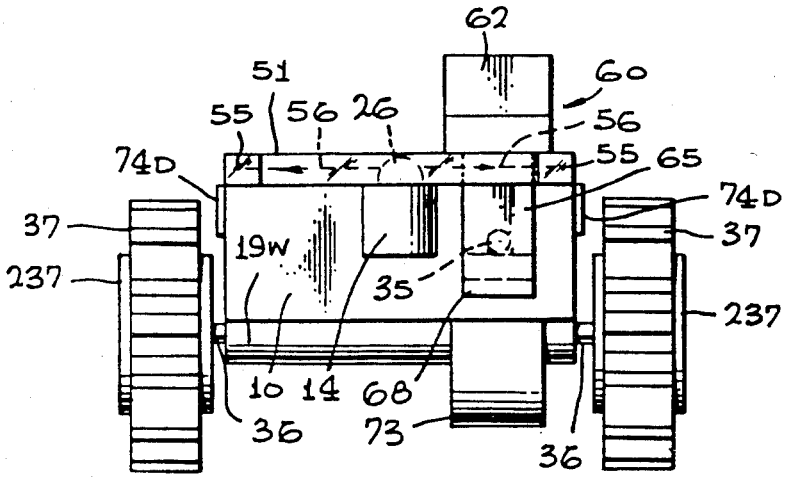
FIG. 8 is an additional elevation, taken from in front of embodiment of FIGS. 1 through 5.

As shown in FIGS. 1, 4 and 5, a preferred embodiment of our invention is built in and around a chassis 10 consisting of upstanding left and right side walls 11, front end wall 12 and rear end wall 13, all erected about the periphery of an extended horizontal floor 19. The front end wall 12 has a forward protrusion 14 which supports and contains functional connections for a small light bulb 26, and which also supports a transparent light distributor 51 to be described in detail below.

The front end wall 12 also has a generally rectangular slot 15, 16 formed in it; and the rear end wall 13 has a similar slot 17, 18—both slots being provided for a purpose to be described.

The chassis 10 serves both as a frame to support and as a partial enclosure to conceal and protect the power source and train.

Mounted below the chassis for rolling rotation with respect to it are two mutually parallel but spaced-apart axles, an axle 36 near the front and an axle 46 near the rear of the chassis. Secured to the ends of these two axles 36 and 46 are respective pairs of wheels—front wheels 237 and rear wheels 247, with corresponding tires 37 and 47, which are thus in effect mounted to the frame for rolling rotation about respective mutually parallel but spaced-apart axes (the centerlines of the axles 36 and 46), one such axis being in front of the other.

Mounted atop the chassis floor 19 at a position between the two axles (or wheel rotation axes) is an electric motor 27. The motor 27 is located against one of the side walls 11, and oriented so that its driveshaft 283 (FIGS. 4 and 5) is perpendicular to the two wheel-rotation axes. This motor is of a type whose driveshaft extends both fore and aft from the motor housing. The motor 27 is secured against longitudinal motion by two blocks 319, which are integral with the chassis floor 19 and the adjacent side wall.

Mounted to the two ends of the motor driveshaft 283 are respective drive pinions 31 at the front and 41 at the rear, which are firmly secured for rotation with the driveshaft.

Below the pinions 31 and 41 and meshed with them are respective spur gears 32 and 42, which rotate on corresponding shafts 35 and 45 oriented parallel to the driveshaft. The spur-gear shafts 35 and 45 are each journalled at one of their respective ends into one of the motor blocks 319, and at the other of their respective ends into the corresponding end wall 12 or 13, in a manner to be detailed below. Sharing the spur-gear shafts 35 and 45 with the spur gears 32 and 42, and firmly secured to those spur gear shafts to rotate with them, are respective worms 33 and 43.

Below these worms 33 and 43, and oriented and disposed to mesh with them, are respective worm gears 34 and 44—each oriented to rotate about axes parallel to the axes of wheel rotation. The worm gears 34 and 44 and the respective wheel pairs 237 and 247 are mounted conaxially (that is, together on the same respective shafts 36 and 46). The gears and wheels are fixed to their corresponding axles, for rotation in common; thus each of the worm gears 34 and 44 drives a respective pair 237 or 247 of wheels.

Thus the wheels may be driven by a symmetrical power train having but two stages and yet providing very high mechanical advantage between the motor driveshaft and the axles, and occupying a narrow space along one side of the chassis 11—and thus leaving the greater width of the chassis for a "penlight" battery 21 (whose positive pole appears at 23), and the appropriate electrical connectors 22 and 24.

From the fact that the dry-cell battery 21 appearing in FIG. 1 is only a size-AA penlight type, the remarkably small overall size of the vehicle may be seen dramatically. Yet, due to the simplicity of the novel drive train, it is not necessary to use highly miniaturized or high-precision gears.

A miniature scale-model vehicle body (such as 74 in FIG. 2) is fitted to the chassis 10, and held on by left and right detents 74D formed in the outsides of the chassis side walls 11. The body 74 snaps on and off to permit easy changing of the battery 21. The body style typically is derived from two or more real vehicle bodies as a composite, with blending features supplied by the scale-model designer.

To obtain excellent traction, the tires 37 and 47 are made of rubber foam or plastic foam. We prefer to use a foam whose cell structure is open to the air—particularly about the periphery of the tire, where it comes in contact with the surface on which the vehicle is operating. We consider this type of material optimal, but other soft pliable material may be substituted if preferred. Best traction also requires that the tires be configured with extremely exaggerated or pronounced tread-cut patterns such as 38.

Some details of the construction of this preferred embodiment of our invention include protective drive-gear wells, such as the rear well 73, encasing the worm gears 34 and 44 respectively, and drive-mechanism cover 60. The drive-mechanism cover 60 includes an elevated section 62 to accommodate the motor 27, lower sections 63 at front and rear to cover the respective worms 33, 43 and worm gears 34, 44, and intermediate cover sections of intermediate height to cover the respective pinions 31, 41. The cover 60 also has a side wall 71 which isolates the drive mechanism from the battery-mounting area, while providing an electrical connection path via the slot 72.

The narrowed end sections 64 of the cover 60 terminate in vertical sections 65, with thinner portions 67 and hooks 68. These vertical end sections snap over detents 71D formed in the respective end walls 12 and 13 of the chassis. In particular the detents 71D are formed as protruding ledges at the bottoms of the slot 15, 16 in the front wall 12 and the slot 17, 18 in the rear wall 13. The thicker upper portions 65 of the vertical end sections of the cover 60 fit into the respective slots 15, 16 and 17, 18.

It may now be noted that the forward end of the forward worm shaft 35 rests in a half-journal formed in the horizontal bottom surface 16 of the slot 15, 16. Likewise the rearward end of the rear worm shaft 45 rests in a half-journal formed in the horizontal bottom surface 18 of the rear slot 17, 18. The upper halves of these two journals are provided by the snap-on end sections 65 of the drive cover 60. The two upper half-journals are visible at 66 in FIG. 1.

Though below the chassis floor proper 19, the axles 36 and 46 are within the chassis enclosure by virtue of axle wells 19W (FIG. 4), which extend to the two sides of the chassis and serve as axle bearings.

Figure 2:
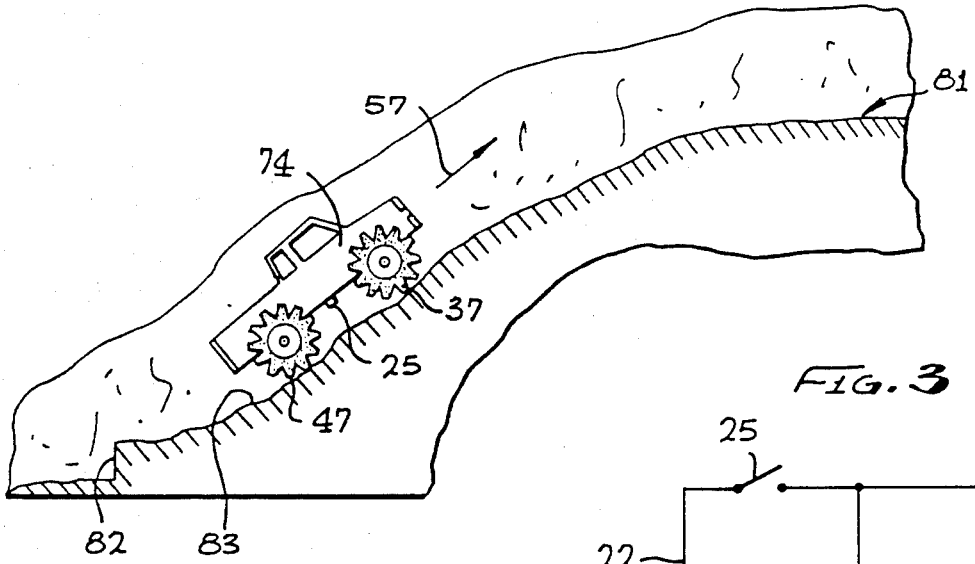
FIG. 2 is a generalized elevation of the embodiment of FIG. 1 in use on an accompanying toy hill, particularly illustrating the climbing capabilities of the toy and also illustrating the appearance of the toy with a scale-model vehicle body in place.
Figure 3:
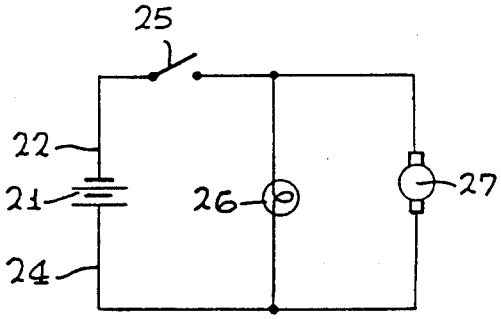
FIG. 3 is a schematic diagram of the electrical circuit employed.

As is apparent from FIG. 3 the circuitry of the toy is generally conventional: battery 21 applies power through contacts 22 and 24 (also see FIG. 1) and switch 25 (also see FIG. 2) to the light bulb 26 and motor 27 in parallel. FIG. 5 shows that the metal contacts 22 and 24 are extended along the side of the battery to respective metallic contacts 222 and 224 which engage appropriate contact points on the motor 27. The user may turn off the motor and light by operating the plastic switch handle 25 (FIGS. 4 and 5) rearward. The inclined-plane surface 223, defined on the upper body portion 221 of the switch handle 25, then forces the angled contact 222 away from the motor 27.

FIG. 3 points up the fact that only a single light bulb is used, though the toy gives the appearance of having two headlamps. This effect is obtained by providing a shallow transparent "light distributor" 51, advantageously polished in some areas, which has a cutout 52 for nearly encircling the lamp 26, and which rests on the projection 14 mentioned earlier. The distributor 51 has angled and polished outer corners 53 for intercepting light rays 56 leaving the bulb in opposite directions and redirecting such rays forward as at 57 through projections 55. While the rear of the light distributor 51 rests upon chassis projection 14, the projections 55 of the distributor itself are engaged with apertures (not shown) in the front of the scale-model vehicle body 74 (FIG. 2). The apertures in the body 74 thus support the front end of the light distributor 51 by its projections 55, while at the same time permitting the forward-directed light rays 57 to pass forward through the end faces of the projections 55 and through the apertures themselves. Thus the "headlights" at the front of the vehicle glow, as suggested at 57 in FIG. 2. It will be apparent that with suitable coloration it would be possible similarly to provide the effect of taillights.

Taking the distance between axles 36 and 46 as compatible with the dimensions of the model vehicle body 74—that is to say, assuming that the axles 36 and 46 are spaced apart by a distance which is correct for the scale of the model body 74—it may now be asked how the scale of the tires 237, 247 compares with the scale of the body and wheelbase. It will be apparent from FIG. 4 that the tires 237 and 247 are substantially "overscale'-'—that is, oversize with respect to the otherwise consistent model body and wheelbase. In fact we have found that making the body 74 at roughly a 56:1 scale and the tires 237 and 247 overscale by about a factor of two, or at least by a factor exceeding about 1.5, results in producing relatively extreme "ground" clearance both between the wheels and fore and aft of the wheels. Scale-model bodies in the range from about 45:1 to about 60:1 would also be suitable. As a result, and in combination with the other features described herein, the toy is able to clamber over objects substantially higher than its front axles (that is to say, taller than the tire radius), as suggested by the vertical step 82 in FIG. 2—and generally to perform in such an outlandish fashion as to lend the toy tremendous appeal and fascination. The mere size of the tires alone imparts a droll appearance which adds to the appeal even when the vehicle is stationary.

Figure 7:
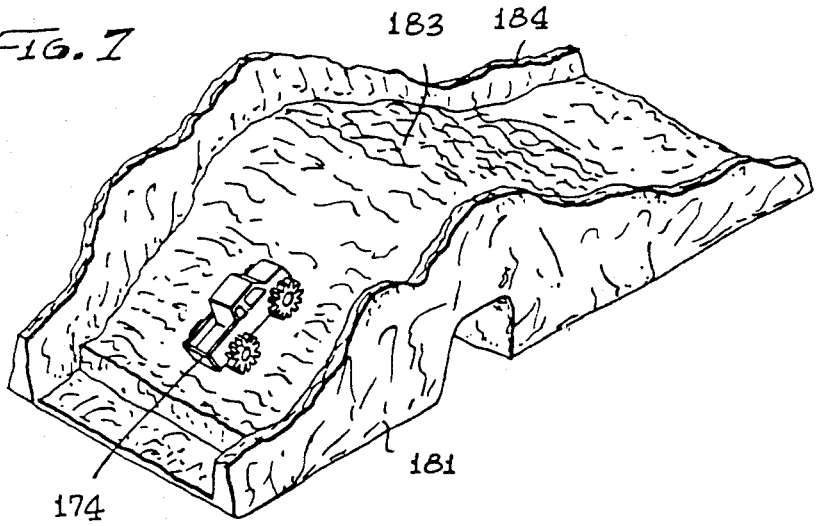
FIG. 7 is a perspective view of a toy "mountain" for use with the toy vehicle, showing more particularly the practical features of a climbing surface to be supplied with the vehicle than does FIG. 2.

Due to the open foam cells of the tires, and the very pronounced tread, the vehicle can find a grip on all but the slipperiest surfaces, even on very steep grades; and due to the high mechanical advantage of the drive train will climb any surface it can rest on and grip. We have found that the preferred embodiment illustrated in FIG. 1 can rest on and grip surfaces of virtually any substances at grades up to about 30°, and with surfaces of high-traction substance such as styrofoam it can operate at grades up to about 40°. The limiting factor at 40° is that the weight of the vehicle is centered at a point very nearly above the rear wheel axle, so that the vehicle is subject to tipping over backward when it bounces over a small bump. The grade at point 83 of FIG. 2 is approximately 40°, to illustrate the extreme capability of the toy vehicle. A climbing surface such as 81 in FIG. 2 is advantageously supplied with the toy vehicle, a more practical version appearing in FIG. 7.

There the "mountain" 181, advantageously made of styrofoam (or other high-traction material), has a steep and irregular climbing surface 183 which is of limited width, for ease of packaging, and is provided with very steep ridges 184 (too steep for the toy 174 to climb), to restrain the toy from falling over the side edges of the climbing surface. In view of the climbing capabilities of the vehicle, effective grades at some parts of the climbing surface 183 should preferably exceed 30° and approach 40°. By "effective grades" we mean the angle of the vehicle to the horizontal, when placed on the surface 183; this definition is useful because the surface 183 is irregular, and the grade over a particular distance smaller than the vehicle wheelbase may exceed 30° or even 40°.

For the preferred embodiment of FIG. 1 we use a motor whose unloaded rotational speed is 3,000 to 10,000 revolutions per minute. The motor of course slows down when the vehicle is climbing a steep grade. We provide a 2:1 gear ratio between the pinion and spur gears 31, 32 and 41, 42; and a further step-down of 20:1 or greater (up to about 25:1) between the worm and worm gear, for an overall reduction or mechanical advantage between 40:1 and 50:1. We believe that the drive train illustrated is optimal for production in ordinary plastic materials. A single-step plastic drive in which the worms were driven directly on the motor driveshaft ends was found unsatisfactory in operation: with a 40:1 or 50:1 mechanical advantage the necessarily finer worm and worm gear could not be held together properly in assembly. Upon impact of the toy vehicle with an obstacle, the worm would bend or otherwise jump out of engagement with the worm gear. Plastic parts could not economically be molded closely enough to make such a system commercially feasible.

Figure 6:
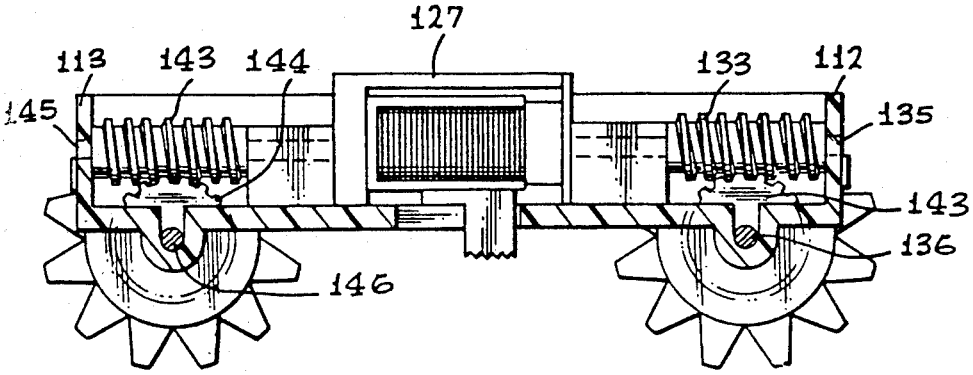
FIG. 6 is an elevation of the drive train only, for an alternative embodiment.

However, we believe that it is possible to use such a system under different performance or economic assumptions to obtain a successful toy. For example, if the cost of the unit can accommodate use of certain critical drive parts made from metal, or if less extreme hill-climbing ability can be accepted so that the driveshaft-to-axle mechanical advantage need be only 20:1 or 25:1, or if provision is made for cushioning the drive mechanism against accepting the complete shock of encountering an obstacle, then the single-step drive system should be usable. This system is shown in FIG. 6.

As there illustrated, the motor 127 driveshaft ends are lower on the motor profile, and directly carry worms 133 and 143. (If preferred, the motor shaft could be higher than shown in FIG. 6, and the worm gear made larger—with an appropriate change in the pitch of the worm to maintain the same reduction.) The motor driveshaft ends 135 (at the forward end) and 145 may be journalled directly in the chassis walls 112 and 113, or provided with suitable bushings (not shown) as appropriate.

The possibly finer-toothed respective worm gears 134 and 144 of course mesh with the worms 133 and 143 generally as in the preferred embodiment previously discussed, driving respective axles 136 and 146 and the corresponding wheels and tires.

It will be understood that the foregoing disclosure is intended to be merely exemplary, and not to limit the scope of our invention—which is to be determined by reference to the appended claims.

In particular, the invention is not limited to use with four-wheel vehicles. It could alternatively be used in vehicles having certain types of tricycle configuration, or even in a hill-climbing toy motorcycle with side supports.

We claim:

1. A miniature electrically self-powered wheeled toy vehicle for use with electrical battery means comprising an elongated dry-cell battery, and capable of climbing over operating surfaces that are rough and that include obstacles as well as climbing up operating surfaces that include steep inclines, said vehicle having major weight components positioned to provide a generally symmetrical, compact, balanced, and relatively low arrangement, while also providing adequate ground clearance in the area between the front and rear wheels, said vehicle comprising:

a frame having a right edge and a left edge;

front wheel means and rear wheel means mounted to the frame for rolling rotation about respective mutually parallel but spaced-apart front and rear axes, the distance between the front and rear axes being generally about two inches;

an electric motor mounted adjacent to one of said edges of the frame, and having a driveshaft which is perpendicular to the two axes and extends both fore and aft from the motor;

means mounted to the frame to releasably support such an elongated dry-cell battery alongside the motor and adjacent the other of said edges of the frame in a position with its longitudinal axis substantially parallel to the driveshaft, the length of such battery extending substantially the full distance between said front and rear axes; the motor and such battery side-by-side substantially occupying the full width between said right and left edges of the frame;

said motor being positioned between said axes and being substantially shorter than the distance between said axes to provide a pair of transmission spaces, one fore and one aft of the motor;

means for electrically connecting such battery, when supported in the supporting means, to the motor, so that such battery powers the motor; and a pair of transmission means, each at least partially disposed in one of said transmission spaces and each comprising a speed reduction mechanism connecting one end of the driveshaft to one of the wheel means to transmit rotation from the driveshaft to such wheel means with reduced speed and with increased power;

at least a major portion of such battery, said motor and said transmission means being at approximately the same height as said front and rear wheel means; and said frame, said motor, such battery and said transmission means not protruding any appreciable distance below the level of said front and rear axes in the area between said front and rear wheel means.

2. The toy vehicle of claim 1 wherein, transverse to the driveshaft, said motor is generally rectangular, having shorter dimension and a longer dimension, said motor being positioned with said shorter dimension extending between said battery means and the frame side.

3. The toy vehicle of claim 1 wherein said motor is generally equally distant between said front and rear axes.

4. The toy vehicle of claim 1 wherein each of said transmission means comprises a worm driven by the motor and a worm gear driving a wheel means.

5. A miniature electrically self-powered wheeled toy vehicle for use with electrical battery means comprising an elongated dry-cell battery, and capable of climbing over operating surfaces that are rough and that include obstacles as well as climbing up operating surfaces that include steep inclines, said vehicle having major weight components positioned to provide a generally balanced and relatively low arrangement, while also providing adequate ground clearance in the area between the front and rear wheels, said vehicle comprising:

a frame simulating a vehicle chassis and adapted to support a toy vehicle body, said frame having a right edge and a left edge;

front wheel means and rear wheel means mounted to the frame for rolling rotation about respective mutually parallel but spaced-apart front and rear axes, the distance between the front and rear axes being generally about two inches;

an electric motor mounted adjacent to one of said edges of the frame, and having a driveshaft which is perpendicular to the two axes and extends both fore and aft from the motor;

means mounted to the frame to releasably support such an elongated dry-cell battery side-by-side with the motor and adjacent the other of said edges of the frame in a position with its longitudinal axis substantially parallel to the driveshaft, the length of such battery extending substantially the full distance between said front and rear axes; such battery and at least the lower portion of the motor being at approximately the same height as said front and rear wheel means;

said motor being positioned between said axes and being substantially shorter than the distance between said axes to provide a pair of transmission spaces, one fore and one aft of the motor;

said frame, said motor and such battery not protruding any appreciable distance below the level of said front and rear axes in the area between said front and rear wheel means, and said frame and such battery not extending any appreciable distance above said wheel means;

means for electrically connecting such battery, when supported in the supporting means, to the motor, so that such battery powers the motor; and a pair of transmission means each at least partially disposed in one of said transmission spaces and each comprising a reduction gear train connecting one end of the drive shaft to one of the wheel means to transmit rotation from the drive shaft to such wheel means with reduced speed and with increased power.

* * * * *